US010569314B2

(12) United States Patent
Hengen

(10) Patent No.: US 10,569,314 B2
(45) Date of Patent: Feb. 25, 2020

(54) METHOD AND APPARATUS FOR REMOVING SLUDGE DEPOSITS FROM OIL STORAGE TANKS

(71) Applicant: Derek J. Hengen, Arcola (CA)

(72) Inventor: Derek J. Hengen, Arcola (CA)

( * ) Notice: Subject to any disclaimer, the term of this patent is extended or adjusted under 35 U.S.C. 154(b) by 0 days.

(21) Appl. No.: 15/059,114

(22) Filed: Mar. 2, 2016

(65) Prior Publication Data

US 2016/0256904 A1 Sep. 8, 2016

(30) Foreign Application Priority Data

Mar. 3, 2015 (CA) ..... 2884314

(51) Int. Cl.
*B08B 9/093* (2006.01)

(52) U.S. Cl.
CPC ..... *B08B 9/0933* (2013.01)

(58) Field of Classification Search
None
See application file for complete search history.

(56) References Cited

U.S. PATENT DOCUMENTS 2,858,836 A * 11/1958 Geh ..... B08B 9/093 134/167 R
4,220,170 A * 9/1980 Hebert ..... B63B 57/02 134/167 R
4,582,612 A * 4/1986 Long, Jr. ..... B01F 3/0473 210/104
5,394,943 A * 3/1995 Harrington ..... E21B 33/04 166/373
5,640,982 A * 6/1997 Landry ..... B08B 9/051 134/167 R
6,125,864 A * 10/2000 Morikawa ..... B08B 9/0813 134/167 R
7,261,109 B2 * 8/2007 Luke ..... B08B 3/024 134/22.1
8,181,890 B2 * 5/2012 Zilai ..... B08B 9/0936 134/167 R
2007/0144602 A1 * 6/2007 Henkin ..... E04H 4/1654 138/120

* cited by examiner

*Primary Examiner* — Cristi J Tate-Sims
(74) *Attorney, Agent, or Firm* — Michael A. Bondi; Moss & Barnett

(57) ABSTRACT

A jet nozzle and assembly for removing sludge deposits in oil storage tanks is provided. The jet nozzle can include a rigid conduit connectable to a pressurize liquid supply, a pivotal connection connected to the rigid conduit and a spray nozzle connected to the pivotal connection so that the spray nozzle can pivot around the proximal end of the spray nozzle. The assembly can include a manway cover attachable to a manway of a tank, a flange member provided on the manway cover with an aperture passing through the manway cover and inside the flange member, a valve connected to the flange member and a spool connected to the valve. A cover having an opening passing therethrough can be attached to the spool. The rigid conduit of the jet nozzle can be inserted through the opening in the cover so that the jet nozzle extends inside the assembly.

22 Claims, 5 Drawing Sheets

METHOD AND APPARATUS FOR REMOVING SLUDGE DEPOSITS FROM OIL STORAGE TANKS

FIELD

The present invention relates to a method and apparatus for removing sludge deposits from oil storage tanks.

BACKGROUND

Large tanks are used to store petroleum, crude oil and various types of partly refined oil. While the oil is being stored, higher or lighter fractions of the oil can separate from heavier fractions. As more and more of the heavier fractions separates out of the oil, the heavier fractions become more and more viscous and can form a "sludge" on the bottom of the tank. This sludge will tend to stay in the tank as the oil in the tank is removed and new oil is stored in the tank. As oil is continually removed from the tank and new oil stored in the tank, the sludge can continue to build up and can reduce the available storage space in the tanks because more and more of the storage capacity of the tank is being used up by this sludge that is staying in the tank.

There are a number of methods presently used to remove this sludge, including removing as much oil as possible from the tank and simply trying to manually excavate the sludge from the tank. However, these tanks are usually quite large; often holding thousands of tons of oil product and can measure 40 feet high or more with diameters of 50 feet to 200 feet or even more. Therefore, manually removing the sludge can be labor intensive, take quite a long time and be quite dangerous.

Another method that is often used to try and remove the sludge from these tanks is to use a water jet to break up the sludge and mix it into an emulsion with water or other liquids so that the emulsified sludge can then be drained from the tank. Often these large tanks will have one or more manway covers provided at or near the ground level. These manway covers are commonly circular access doors that bolt onto the outside of the tank. By undoing the bolts and pulling off the manway cover, a person can gain access to the inside of the tank Often the water jet is provided installed in a manway cover sized plate that bolts into the opening where the manway has been removed. This water jet is rotatable using a ball and socket joint. With the water jet installed in the manway cover it can be used to blast water into the tank to try and mix up the sludge so it can be drained. A person can move the hose attached to the water jet which in turn will rotate the nozzle with the ball and socket to re-direct the direction of the water jet.

However, the problem with this method is that the manway covers are placed quite low in the tank (typically just above the ground level so that they are easily accessible by a person standing on the ground) often the sludge can build up to a level higher than the manway cover and cause a spill on the ground when the manway cover is removed. Even if a spill is not caused right away, the sludge is often not of a consistent height in the bottom of the tank and instead form ridges and valleys inside the tank. When the manway cover is removed, sludge might not spill out of the manway immediately, however, once it is disturbed during the installation of the water jet, a spill could occur at any time during installation.

SUMMARY OF THE INVENTION

In an aspect, an apparatus for removing sludge deposits in oil storage tanks is provided. The apparatus can comprise: a rigid conduit having a proximal end and a connection end, the connection end connectable to a pressurized liquid supply; a pivotal connection connected to the proximal end of the rigid conduit; a spray nozzle having a proximal end and a discharge end, the proximal end of the spray nozzle connected to the pivotal connection so that the spray nozzle can pivot around the proximal end of the spray nozzle; and at least one movement actuator operative to pivot the spray nozzle around the pivotal connection.

In another aspect, a system for removing sludge deposits in oil storage tanks is provided. The system can include an assembly and a jet nozzle. The assembly can comprise: a manway cover attachable to a manway of a tank; a flange member provided on the manway cover with an aperture passing through the manway cover and inside the flange member; a valve operatively connected to the flange member; a spool operatively connected to the valve at a first end and having a flange at a second end; and a cover attachable to the flange at the second end of the spool and having an opening passing therethrough. The jet nozzle can comprise: a rigid conduit having a proximal end and a connection end, the connection end connectable to a pressurized liquid supply and the rigid conduit sized to slide through the opening in the cover of the assembly; a pivotal connection connected to the proximal end of the rigid conduit; a spray nozzle having a proximal end and a discharge end, the proximal end of the spray nozzle connected to the pivotal connection so that the spray nozzle can pivot around the proximal end of the spray nozzle; and at least one movement actuator operative to pivot the spray nozzle around the pivotal connection.

In a further aspect, a method for retrofitting an assembly on a tank for removing sludge deposits in the tank is provided. The method can comprise: attaching a flange member onto the manway cover; connecting a valve to the flange member; connecting a first end of a spool to the valve; connecting a cover having an opening passing therethrough to a second end of the spool; passing a hole saw through the opening in the cover, opening the valve and using the hole saw to cut a hole in the manway cover; retracting the hole saw back through the valve and closing the valve; removing the cover and installing a jet nozzle passing through the opening in the cover; and reattaching the cover to the second end of the spool with the jet nozzle extending inside the spool.

DESCRIPTION OF THE DRAWINGS

A preferred embodiment of the present invention is described below with reference to the accompanying drawings, in which.

DETAILED DESCRIPTION OF THE ILLUSTRATED EMBODIMENTS

Figure 1:
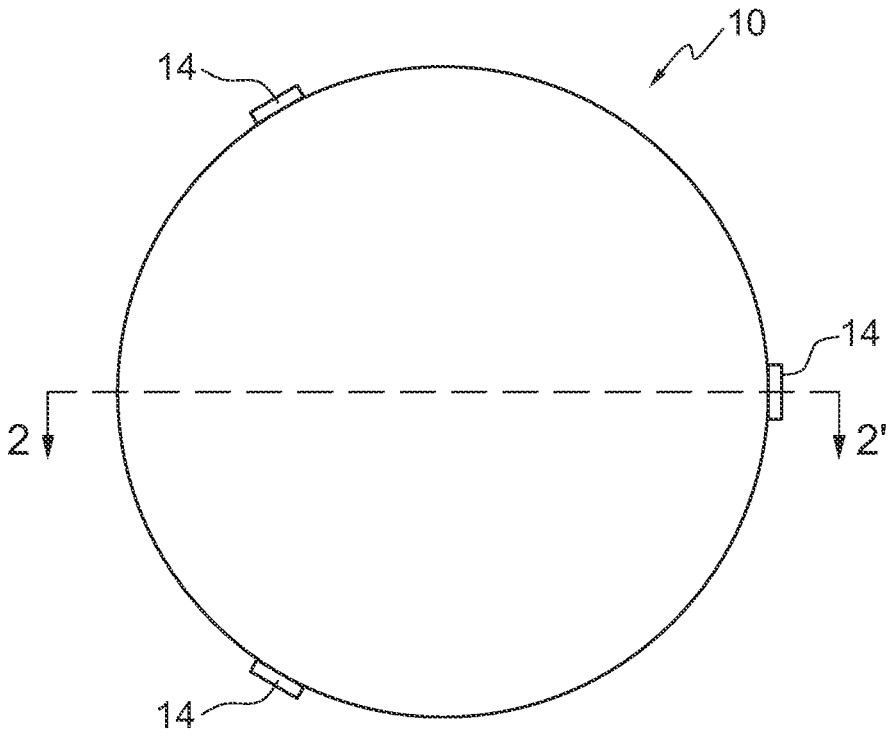
FIG. 1 is a schematic top view of a tank for storing oil.
Figure 2:
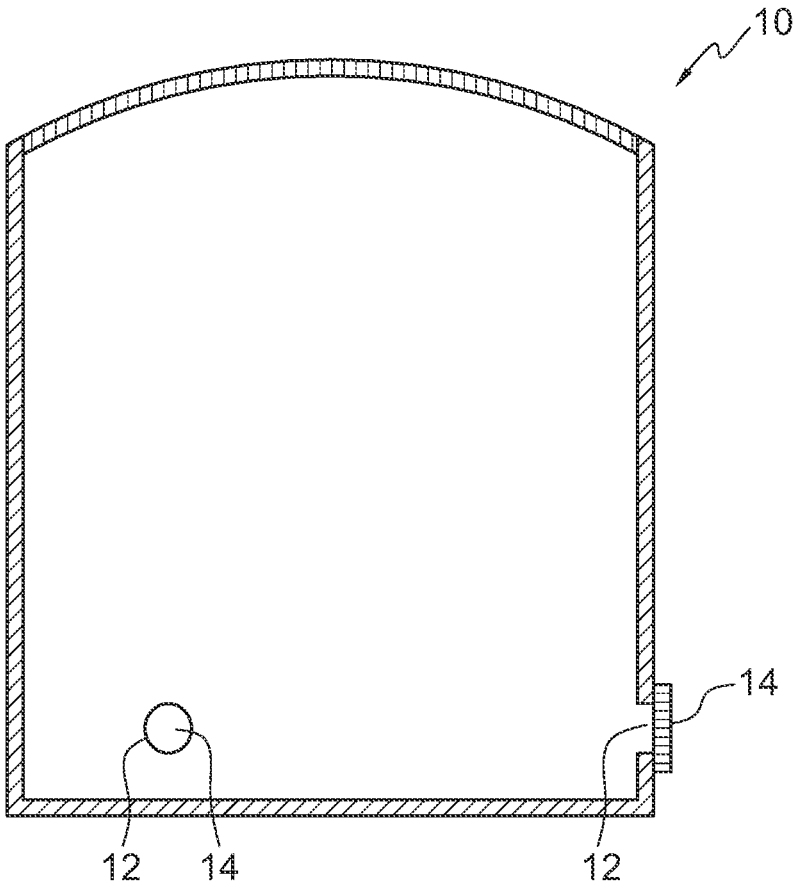
FIG. 2 is a sectional view of the tank of FIG. 1 taken along line 2-2' in FIG. 1.

FIGS. 1 and 2 illustrate a tank 10 for storing petroleum, crude oil and various types of partly refined oil. One or more manways 12 and manway covers 14 are positioned near a bottom of the tank 10 to provide access into interior of the tank 10 through one or more of the manways 12 once the manway cover 14 is removed.

Figure 3:
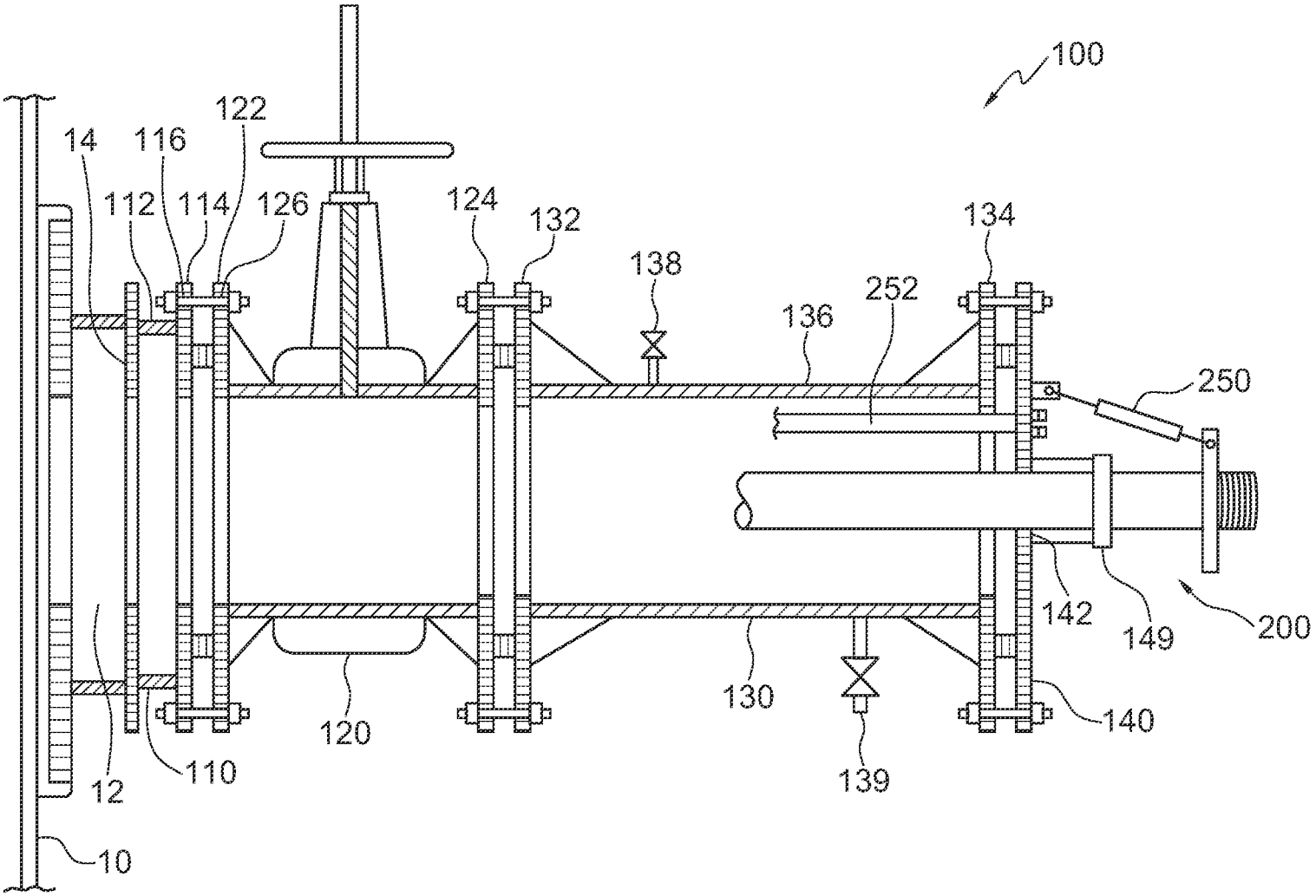
FIG. 3 is a schematic view of an assembly for providing a jet nozzle with access to the interior or a tank.

FIG. 3 illustrates an assembly 100 that can be provided on a manway cover 14 to allow a jet nozzle 200 to be inserted into the tank 10 to try and remove sludge deposits in the bottom of the tank 10. The assembly 100 can have a flange member 110, a gate valve 120, a spool 130 and a cover 140. The flange member 110 can have a cylindrical section 112 with a flange 114 comprising a series of bolt holes 116 positioned around the flange 114. The gate valve 120 can be a standard gate valve with a full port so that the port is not smaller than the inlet and outlet when the port is open. The gate valve 120 can have flanges 122, 124 on either side. A first flange 122 can be sized to match the flange 114 on the flange member 110 so that bolt holes 126 in the first flange 122 match up with the bolt holes 116 in the flange 114 of the flange member 110. The spool 130 can have two flanged ends, a first end 132 and a second end 134 and a cylindrical length 136 in between the flanges 132, 134. A gas vent 138 and a drain valve 139 can be provided in the spool 130 to allow the venting of gas and the draining of fluid, respectively. Flange 132 can be attached to flange 124 on the spool valve 120 and the cover 140 can be connected to the flange 134 on the spool 130 to close it off.

The assembly 100 can be provided on the manway cover 14 before the manway cover 14 is attached to the manway 12 and the tank 10 is filled with oil. However, if the tank 10 is already filled with oil and the sludge deposits have already built up in the tank 10, the assembly 100 can be hot tapped onto the manway cover 14 to gain access into the interior of the tank 10. The hot tapping will allow the assembly 100 to be installed on the manway cover 14 while preventing sludge in the tank 10 from spilling out onto the ground outside the tank 10.

The assembly 100 can be installed on the manway cover 14 while the tank 10 contains sludge by first attaching the flange member 110 to the manway cover 14 with the flange 114 positioned out. The flange member 110 would typically be attached by welding.

Next, the gate valve 120 can be attached to the flange member 110 by attaching one of the flanges 122 of the gate valve 120 to the flange 114 of the flange member 110. Bolts can be placed through the bolt holes 116, 126 on each flange 114, 122 and tightened with nuts to secure the gate valve 120 to the flange member 110. Typically, a gasket and/or sealer can be used to ensure a proper seal between the flange member 110 and the gate valve 120.

The spool 130 can be attached to the other flange 124 of the gate valve 120. Again, a gasket and/or sealer can be used and bolts can be placed through bolt holes in the flanges 124, 132 and nuts used to secure the spool 130 to the gate valve 120.

The cover 140 can be attached to the spool 130.

With the flange member 110 welded to the manway cover 14 and the gate valve 120 and spool 130 attached to the flange member 110, a hole can be cut through the manway cover 14 inside of the flanged member 110. A hole saw (not shown) can be used for cutting a hole in the manway cover 14. The hole saw can be inserted through an opening 142 in the cover 140 attached to the second end 134 of the spool 130 so that the hole saw extends into the interior of the spool 130.

The hole saw would typically be provided on a long shaft that has a length longer than the spool 130 and gate valve 120 combined. The gate valve 120 can then be opened so that the hole saw (on the end of the shaft) can be inserted through the open gate valve 120 and placed in contact with the manway cover 14. With the cover 140 secured to the second end 134 of the spool 130 and the shaft of the hole saw inserted through the opening 142 in the cover 140, if there is good sealing between the opening 142 and the shaft of the hole saw, the contents of the tank 10 will be isolated from the outside as a hole is made in the manway cover 14. Even if the opening 142 is not tightly sealed to the shaft of the hole saw, the spool 130 will prevent sludge, gases, etc. from spilling onto the ground outside the tank 10 when the hole is made in the manway cover 14.

To create a hole in the manway cover 14 with the hole saw, a drill can be attached to the end of the shaft of the hole saw and used to rotate the shaft and therefore the hole saw against the manway cover 14 until the hole saw cuts a hole through the manway cover 14. Once the hole is created in the manway cover 14, the hole saw can be retracted backwards from the manway cover 14 and back out pas the gate valve 120. The cover 140 that is attached to the end of the spool 130 can keep any sludge or other material that has spilled out through the hole cut in the manway cover 14 contained in the gate valve 120 and the spool 130. Once the hole saw is retracted back past the gate valve 120, the gate valve 120 can be closed to seal off the portion of the assembly 100 between the closed gate valve 120 and the hole cut in the manway cover 14 containing any sludge or other materials in the tank 10 and this portion of the assembly 100. In this manner, with the gate valve 120 closed, material in the tank 10 will still be contained within the tank 10.

With the gate valve 120 closed, the interior of the spool 130 can be depressurized using the gas vent 138 (if it is necessary) and any liquid or sludge that has accumulated in the spool 130 drained using the drain valve 139. With the interior of the tank 10 once again sealed and any material that has leaked out removed from the spool 130, the hole saw can be removed from the interior of the assembly 100. This could involve removing the cover 140 to remove the hole saw and shaft.

With a hole now hot tapped into the tank 10 through the manway cover 14 access to the sludge in the bottom of the tank 10 can now be gained so that a jet nozzle can be used to spray water into the tank and mix up the sludge into an emulsified slurry for removal. However, conventional jet nozzles cannot be used because they bolt right onto the manway 12 when the manway cover 14 is removed. Additionally, these conventional jet nozzles have a pivot point that is positioned approximately where the manway 12 is. These jet nozzles must be moved around their pivot points manually so that they can be aimed at different locations inside the tank 10 in order to increase the mixing and emulsification of the sludge. However, the use of the assembly 100 with its flanged tee 110, gate valve 120 and spool 130, while needed to prevent the sludge from spilling from the tank 10 when access to the interior of the tank 10 is first gained, prevents a conventional jet nozzle from being used because a conventional jet nozzle cannot be inserted through the interior of the assembly 100 because the jet nozzle cannot be inserted through the spool 130, gate valve 120 and tee flange 110 and even if it could somehow be inserted through these elements, it would not be able to be aimed in different directions inside the tank 10 because a person would have to be able to reach in and aim it and the size of the hole in the manway cover 14 would reduce the range of motion it would have.

Figure 4:
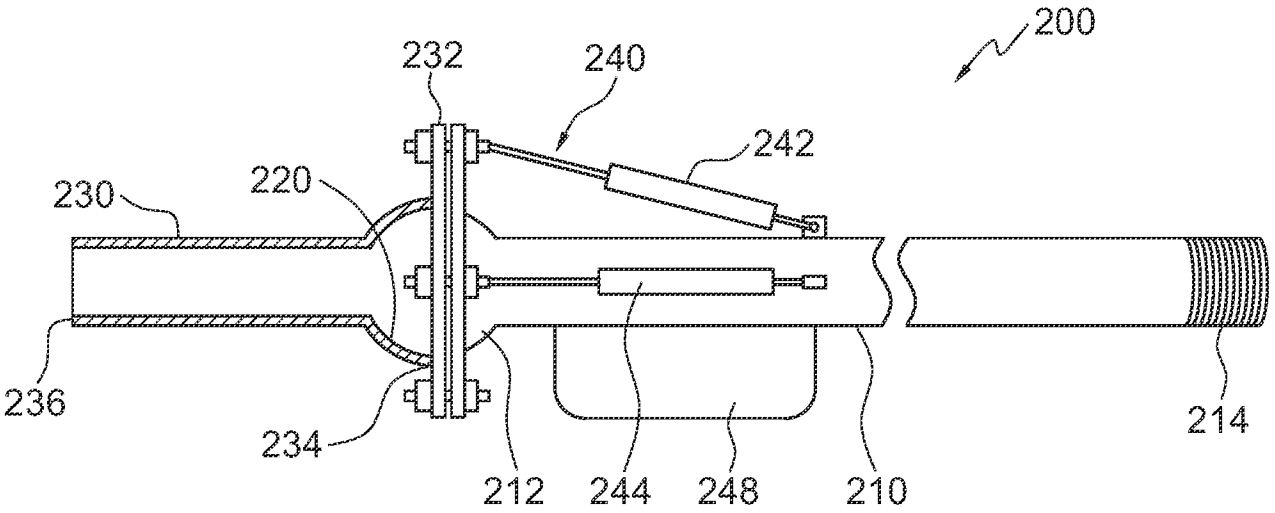
FIG. 4 is a schematic view of a jet nozzle for use with the assembly shown in FIG. 3.

FIG. 4 illustrates a jet nozzle 200 for use with the assembly 100. The jet nozzle 200 can have a rigid conduit 210, a pivotal connection 220, a spray nozzle 230 and movement actuators 240.

The spray nozzle 230 can have a proximal end 234 and a discharge end 236. The proximal end 234 of the spray nozzle 230 can be attached to the pivotal connection 220 so that the spray nozzle 230 can pivot around its proximal end 234 and the pivotal connection 220. In this manner, the pivotal connection 220 allows the spray nozzle 230 to pivot relative to the rigid conduit 210. The pivotal connection 220 can be a ball and socket or connection or other suitable connection that will allow the spray nozzle 230 to pivot relative to the rigid conduit 210.

The movement actuators 240 are attached to the spray nozzle 230 so that the movement actuators 240 can pivot the spray nozzle 230 around its proximal end 234 and the pivotal connection 220 relative to the rigid conduit 210. In one aspect, the movement actuators 240 can be a first hydraulic cylinder 242 and a second hydraulic cylinder 244. The first hydraulic cylinder 242 can be positioned between the rigid conduit 210 a flange 232 on the spray nozzle 230 so that the first hydraulic cylinder 242 can move the spray nozzle 230 in a first direction. In the case of the jet nozzle 200 shown in FIG. 4 this first direction would be vertical (or up and down) relative to the rigid conduit 210. The second hydraulic cylinder 244 can be provided between the rigid conduit 210 and the flange 232 on the spray nozzle 230 so that the second hydraulic cylinder 244 can move the spray nozzle 230 in a second direction. In the case of the jet nozzle shown in FIG. 4 this second direction would be horizontal (or from side to side) relative to the rigid conduit 210. With the first hydraulic cylinder 242 and the second hydraulic cylinder 244, the spray nozzle 230 can be pivoted in a range of directions relative to the rigid conduit 210.

The rigid conduit 210 will have a length that is relative to the length of the assembly 100 so that the length of the rigid conduit 210 is longer than the length of the assembly 100. The rigid conduit 210 can have a proximal end 212 and a connection end 214. The proximal end 212 can be connected to the pivotal connection 220 and the connection end 214 can be connected to a pressurized water or other liquid supply, so that pressurized water or other liquid can be supplied to the jet nozzle 200.

A set of guide plates 248 can be provided on the rigid conduit 210 to help guide the jet nozzle 200 through the inside of the assembly 100.

Referring again to FIG. 3, the cover 140 that can be attached to the second flange 134 of the spool 130 can also be used with the jet nozzle 200. The cover 140 can be removed from the spool 130 and the rigid conduit 210 of the jet nozzle 200 inserted through the opening 142 in the cover 140. The cover 140 can then be reattached to the flange 134 of the spool 130 so that the spray nozzle 230, pivotal connection 220, movement actuators 240 and part of the length of the rigid conduit 210 are positioned inside the spool 130 and behind the closed gate valve 120. The opening 142 in the cover 140 can be sized to accept the rigid conduit 210 so that the rigid conduit 210 can slide back and forth through the opening 142. A seal 149 can be provided to form a seal between the opening 142 and the rigid conduit 210.

Because the spray nozzle 230, pivotal connection 220 and the rigid conduit 210 must be able to fit inside the assembly 100, the spray nozzle 230, pivotal connection 220 and the rigid conduit 210 must all have outer dimensions that are less than the inner dimensions of the hole in the manway cover 14, the tee flange 110, the open port of the gate valve 120 and the spool 130.

Figure 5:
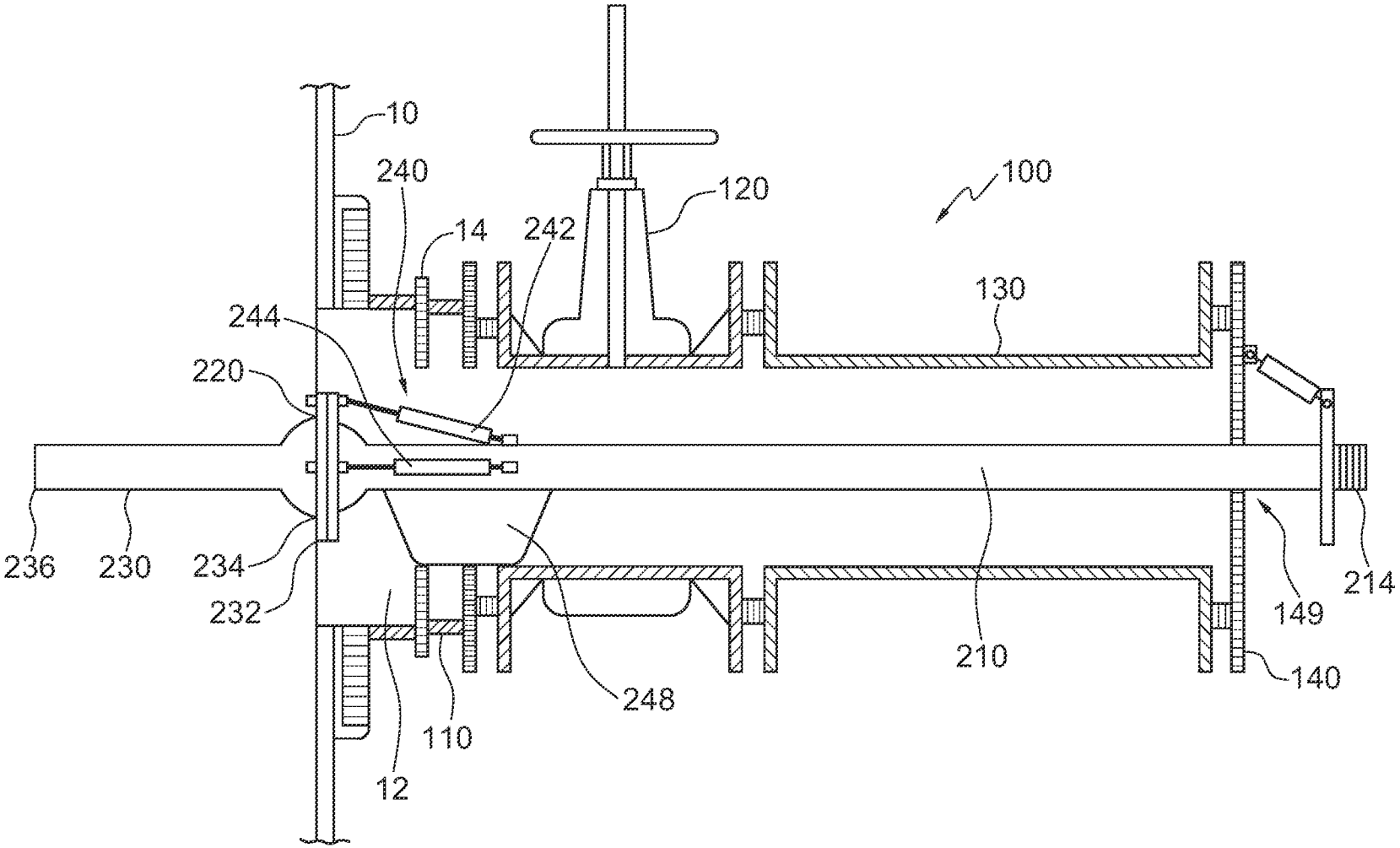
FIG. 5 is a schematic illustration of the jet nozzle of FIG. 4 installed in the assembly of FIG. 3.

FIG. 5 is a schematic illustration of the jet nozzle 200 installed within the assembly 100 and the spray nozzle 230 extending into the interior of the tank 10 with the pivotal connection 220 placed approximate in the manway 12.

A pressurize water (or other liquid) supply can then be connected to the connection end 214 of the rigid conduit 210 so that pressurized water can be supplied to the jet nozzle 200. With the spray nozzle 230 and pivotal connection 220 sealed inside the spool 130, the gate valve 120 can be opened so that the spray nozzle 230 of the jet nozzle 200 can be inserted through the gate valve 120 and through the hole that has been cut in the manway cover 14. The spray nozzle 230 can be continued to be inserted through the hole that has been made in the manway cover 14 until the pivotal connection 220 is proximate the hole in the manway cover 14, either positioned just before the hole or even extending past the hole and inside the tank 10.

Hydraulic lines 252 can be provided passing through the cover 140 to selectively supply hydraulic fluid to the first hydraulic cylinder 242 and the second hydraulic cylinder 244 when the jet nozzle 200 is sealed inside the assembly 100 to control the pivoting of the spray nozzle 230 around the pivotal connection 220 and relative to the rigid conduit 210.

In one aspect, a feed actuator 250 can be provided to feed the jet nozzle 200 through the hole in the manway cover 14. The feed actuator 250 can be a hydraulic cylinder that is positioned between the cover 140 and the rigid conduit 210 to force the jet nozzle 200 further into the assembly 100.

With the jet nozzle 200 in place so that the spray nozzle 230 is extending into the tank 10, water or some mixture of water, solvents, chemicals, lighter fractions of oil from near the top of the tank 10, etc. can be supplied to the jet nozzle 200 to create a stream of liquid being sprayed into the tank 10 to try and mix up and emulsify the sludge in the bottom of the tank 10. When it has been decided that the water spray from the spray nozzle 230 has been directed in one direction for long enough, the movement actuators 240 can be used to change the direction of the spray nozzle 230, directing the spray of water to another spot inside the tank 10. In this manner, the spray can be moved around inside the tank 10 using the movement actuators 240 to try get all of the sludge in the tank 10.

The foregoing is considered as illustrative only of the principles of the invention. Further, since numerous changes and modifications will readily occur to those skilled in the art, it is not desired to limit the invention to the exact construction and operation shown and described, and accordingly, all such suitable changes or modifications in structure or operation which may be resorted to are intended to fall within the scope of the claimed invention.

The invention claimed is:

1. An apparatus for removing sludge deposits in oil storage tanks, the apparatus comprising:

a rigid conduit having a proximal end and a connection end, the connection end connectable to a pressurized liquid supply;

a pivotal connection connected to the proximal end of the rigid conduit;

a spray nozzle having a proximal end and a discharge end, the proximal end of the spray nozzle connected to the pivotal connection so that the spray nozzle is pivotal a limited amount in any direction around the proximal end of the spray nozzle; and two movement actuators operative to pivot the spray nozzle around the proximal end of the spray nozzle in any direction, wherein the two movement actuators comprise a first hydraulic cylinder operatively connected between the rigid conduit and the spray nozzle so that the first hydraulic cylinder pivots the spray nozzle around the pivotal connection and the proximal end of the spray nozzle in a first direction.

2. The apparatus of claim 1 wherein the pivotal connection is a ball and socket.

3. The apparatus of claim 1 wherein the two-movement actuators further comprise a second hydraulic cylinder operatively connected between the rigid conduit and the spray nozzle so that the second hydraulic cylinder pivots the spray nozzle around the pivotal connection and the proximal end of the spray nozzle in a second direction.

4. The apparatus of claim 3 wherein the first direction is vertical relative to the rigid conduit and the second direction is horizontal relative to the rigid conduit.

5. The apparatus of claim 1 wherein the pressurized liquid supply is a hose.

6. The apparatus of claim 1 further comprising a guide plate provided on the rigid conduit.

7. The apparatus of claim 1 further comprising a cover having an opening sized to allow the rigid conduit to slide through the opening.

8. The apparatus of claim 7 further comprising a feed actuator operably connectable between the rigid conduit and the cover to force the rigid conduit through the opening in the cover.

9. The apparatus of claim 8 wherein the feed actuator is a hydraulic cylinder.

10. The apparatus of claim 7 wherein a seal is provided to form a seal between the opening and the rigid conduit when the rigid conduit is positioned passing through the opening.

11. A system for removing sludge deposits in oil storage tanks, the system comprising:

an assembly comprising:

a manway cover attachable to a manway of a tank;

a flange member provided on the manway cover with an aperture passing through the manway cover and inside the flange member;

a valve operatively connected to the flange member;

a spool operatively connected to the valve at a first end and having a flange at a second end; and a cover attachable to the flange at the second end of the spool and having an opening passing therethrough, and a jet nozzle comprising:

a rigid conduit having a proximal end and a connection end, the connection end connectable to a pressurized liquid supply and the rigid conduit sized to slide through the opening in the cover of the assembly;

a pivotal connection connected to the proximal end of the rigid conduit;

a spray nozzle having a proximal end and a discharge end, the proximal end of the spray nozzle connected to the pivotal connection so that the spray nozzle is pivotal a limited amount in any direction around the proximal end of the spray nozzle; and two movement actuators operative to pivot the spray nozzle around the proximal end of the spray nozzle in any direction, wherein the valve is operatively connected between the flange member and the spool, and wherein the spray nozzle, the pivotal connection and the rigid conduit have outer dimensions that are less than inner dimensions of the aperture in the manway cover, the flange member, an open port of the valve and the spool, whereby the spray nozzle, the pivotal connection and the rigid conduit can pass through the aperture in the manway cover, the flange member, the open port of the valve and the spool.

12. The system of claim 11 wherein the rigid conduit is longer than the assembly.

13. The system of claim 11 wherein the pivotal connection is a ball and socket.

14. The system of claim 11 wherein the two movement actuators comprise a first hydraulic cylinder operatively connected between the rigid conduit and the spray nozzle so that the first hydraulic cylinder pivots the spray nozzle around the pivotal connection and the proximal end of the spray nozzle in a first direction.

15. The system of claim 14 wherein the the two-movement actuators further comprise a second hydraulic cylinder operatively connected between the rigid conduit and the spray nozzle so that the second hydraulic cylinder pivots the spray nozzle around the pivotal connection and the proximal end of the spray nozzle in a second direction.

16. The system of claim 15 wherein the first direction is vertical relative to the rigid conduit and the second direction is horizontal relative to the rigid conduit.

17. The system of claim 11 wherein the pressurized liquid supply is a hose.

18. The system of claim 11 further comprising a guide plate provided on the rigid conduit.

19. The system of claim 11 further comprising a cover having an opening sized to allow the rigid conduit to slide through the opening.

20. The system of claim 19 further comprising a feed actuator operable connectable between the rigid conduit and the cover to force the rigid conduit through the opening in the cover.

21. The system of claim 20 wherein the feed actuator is a hydraulic cylinder.

22. The system of claim 11 wherein a seal is provided to form a seal between the opening and the rigid conduit when the rigid conduit is positioned through the opening.

* * * * *